US011631322B2

(12) United States Patent
Lin

(10) Patent No.: US 11,631,322 B2
(45) Date of Patent: Apr. 18, 2023

(54) COLLABORATIVE CONTROL SYSTEM FOR A VEHICLE

(71) Applicant: AEON MOTOR CO., LTD., Tainan (TW)

(72) Inventor: Tong-Min Lin, Tainan (TW)

(73) Assignee: AEON MOTOR CO., LTD., Tainan (TW)

( * ) Notice: Subject to any disclaimer, the term of this patent is extended or adjusted under 35 U.S.C. 154(b) by 59 days.

(21) Appl. No.: 17/360,448

(22) Filed: Jun. 28, 2021

(65) Prior Publication Data

US 2022/0246030 A1 Aug. 4, 2022

(30) Foreign Application Priority Data

Feb. 3, 2021 (TW) ..... 110104038

(51) Int. Cl.
*G08G 1/01* (2006.01)
*G08G 1/052* (2006.01)
(Continued)

(52) U.S. Cl.
CPC ..... *G08G 1/052* (2013.01); *G08G 1/0116* (2013.01); *G08G 1/0133* (2013.01);
(Continued)

(58) Field of Classification Search
CPC .... G08G 1/052; G08G 1/0116; G08G 1/0133; G08G 1/0141; G08G 1/096822; G08G 1/0969
See application file for complete search history.

(56) References Cited

U.S. PATENT DOCUMENTS

2012/0249343 A1* 10/2012 Thomas ..... G08G 1/096783 340/905
2016/0189544 A1* 6/2016 Ricci ..... G08G 1/096827 701/117
(Continued)

FOREIGN PATENT DOCUMENTS

CN 105761521 * 12/2015 ..... G08G 1/07
CN 106056430 A 10/2016
(Continued)

OTHER PUBLICATIONS

"C-ITS Platform Final Report," Jan. 2016, pp. 1-140, retreived from https://ec.europa.eu/transport/sites/transport/files/themes/its/doc/c-its-platform-final-report-january-2016.pdf.
Extended European Search Report for European Application No. 21182680.5, dated Jan. 4, 2022.

*Primary Examiner* — Hongmin Fan
(74) *Attorney, Agent, or Firm* — Birch, Stewart, Kolasch & Birch, LLP

(57) ABSTRACT

A collaborative control system for a vehicle has a cloud server, a collaboration device, and an edge computing device. The cloud server stores road coordinates and traffic data corresponding to the road coordinates. The collaboration device is for being mounted in the vehicle. The edge computing device communicates with the cloud server and the collaboration device and is for being mounted in the vehicle. The edge computing device downloads one of the traffic data from the cloud server as an instant traffic datum according to a vehicle positioning coordinate corresponding to one of the road coordinates, and transmits the instant traffic datum to the collaboration device. The collaboration device displays the instant traffic datum.

14 Claims, 5 Drawing Sheets

(51) Int. Cl.
*G08G 1/0968* (2006.01)
*G08G 1/0969* (2006.01)

(52) U.S. Cl.
CPC ..... *G08G 1/0141* (2013.01); *G08G 1/0969* (2013.01); *G08G 1/096822* (2013.01)

(56) References Cited

U.S. PATENT DOCUMENTS

| | | | | |
|---|---|---|---|---|
| 2018/0061151 | A1 | 3/2018 | Chainer et al. | |
| 2019/0279440 | A1 | 9/2019 | Ricci | |
| 2020/0026290 | A1 | 1/2020 | Lim | |
| 2020/0322476 | A1 | 10/2020 | Cohen et al. | |
| 2020/0351106 | A1* | 11/2020 | Klein | H04L 63/18 |
| 2021/0409379 | A1* | 12/2021 | Hwang | G06V 10/25 |

FOREIGN PATENT DOCUMENTS

| | | | | |
|---|---|---|---|---|
| CN | 108257417 | * | 12/2016 | |
| CN | 107038885 | * | 5/2017 | G08G 1/012 |
| CN | 109831516 | A | 5/2019 | |
| CN | 110660221 | A | 1/2020 | |
| CN | 111915896 | * | 2/2020 | G08G 1/01 |
| CN | 111429724 | * | 4/2020 | G08G 1/012 |
| CN | 210833580 | U | 6/2020 | |
| CN | 111367292 | A | 7/2020 | |
| CN | 111081020 | B | 11/2020 | |
| CN | 112289059 | A | 1/2021 | |
| TW | 200634676 | A | 10/2006 | |
| TW | M576711 | U | 4/2019 | |

* cited by examiner

COLLABORATIVE CONTROL SYSTEM FOR A VEHICLE

CROSS REFERENCE TO RELATED APPLICATIONS

The present application claims priority to Taiwan application No. 110104038, filed on Feb. 3, 2021, the content of which is hereby incorporated by reference in its entirety.

BACKGROUND OF THE INVENTION

1. Field of the Invention

The present invention relates generally to a control system for a vehicle, and more particularly to a collaborative control system for the vehicle.

2. Description of Related Art

Vehicle, such as a car, is a common means of transportation nowadays. Roads provide paths for the car to go, extending in the urban areas and the suburb areas. Further, the infrastructure in a country includes roads such as freeways and expressways. The government adopts some measures to control the traffic conditions. For example, different roads may have different speed limits. Static traffic signs may be mounted on roadsides to prompt the speed limits. Besides, specific road sections may have speed cameras. The purpose of these measures is to catch the driver's attention for the driver to avoid over speeding.

However, the vehicle on a trip may go through multiple types of roads. For example, the vehicle may enter the highway from the urban area. Or, the vehicle may leave the highway and then enter the suburb area. Different road types may have different speed limits. As a result, when the driver is driving the vehicle, the driver not only has to focus attention on the road conditions in front of and around the vehicle, but also has to divert the attention to the traffic signs at the roadsides. Especially, when the vehicle passes through the traffic sign so fast, the driver can see and comprehend the traffic sign just in a moment. The driver may not firmly keep the rule on the traffic sign in mind or may not clearly see and comprehend the traffic sign, and thus may violate the traffic rules.

SUMMARY OF THE INVENTION

An objective of the present invention is to provide a collaborative control system for a vehicle to overcome the defect that the driver may not firmly keep the rule of the traffic sign in mind or may not clearly see and comprehend the traffic sign, therefore violating the traffic rule when the driver is driving the vehicle because the traffic signs only provide the static warning effect and such warning effect is limited.

The collaborative control system of the present invention has a cloud server, a collaboration device, and an edge computing device. The cloud server stores road coordinates and traffic data corresponding to the road coordinates. The collaboration device is for being mounted in the vehicle. The edge computing device communicates with the cloud server and the collaboration device and is for being mounted in the vehicle. The edge computing device downloads one of the traffic data from the cloud server as an instant traffic datum according to a vehicle positioning coordinate corresponding to one of the road coordinates, and transmits the instant traffic datum to the collaboration device. The collaboration device displays the instant traffic datum.

As the collaborative control system of the present invention mentioned above, the collaboration device and the edge computing device are for being mounted in the vehicle. According to the collaboration among the cloud server, the collaboration device and the edge computing device, when the driver is driving the vehicle, no matter where the vehicle goes, the cloud server provides the latest traffic datum all the time. The edge computing device continuously receives the instant traffic datum and activates the collaboration device to display the instant traffic datum.

Therefore, the present invention provides the driver with a direct way to receive the instant traffic datum, such that the driver may just take a look at the collaboration device when driving the vehicle, rather than pay a lot of attention on the traffic signs. The driver can focus attention on the road conditions in front of and around the vehicle and obey related traffic rules based on the instant traffic datum provided by the present invention.

DETAILED DESCRIPTION OF PREFERRED EMBODIMENT(S)

Figure 1:
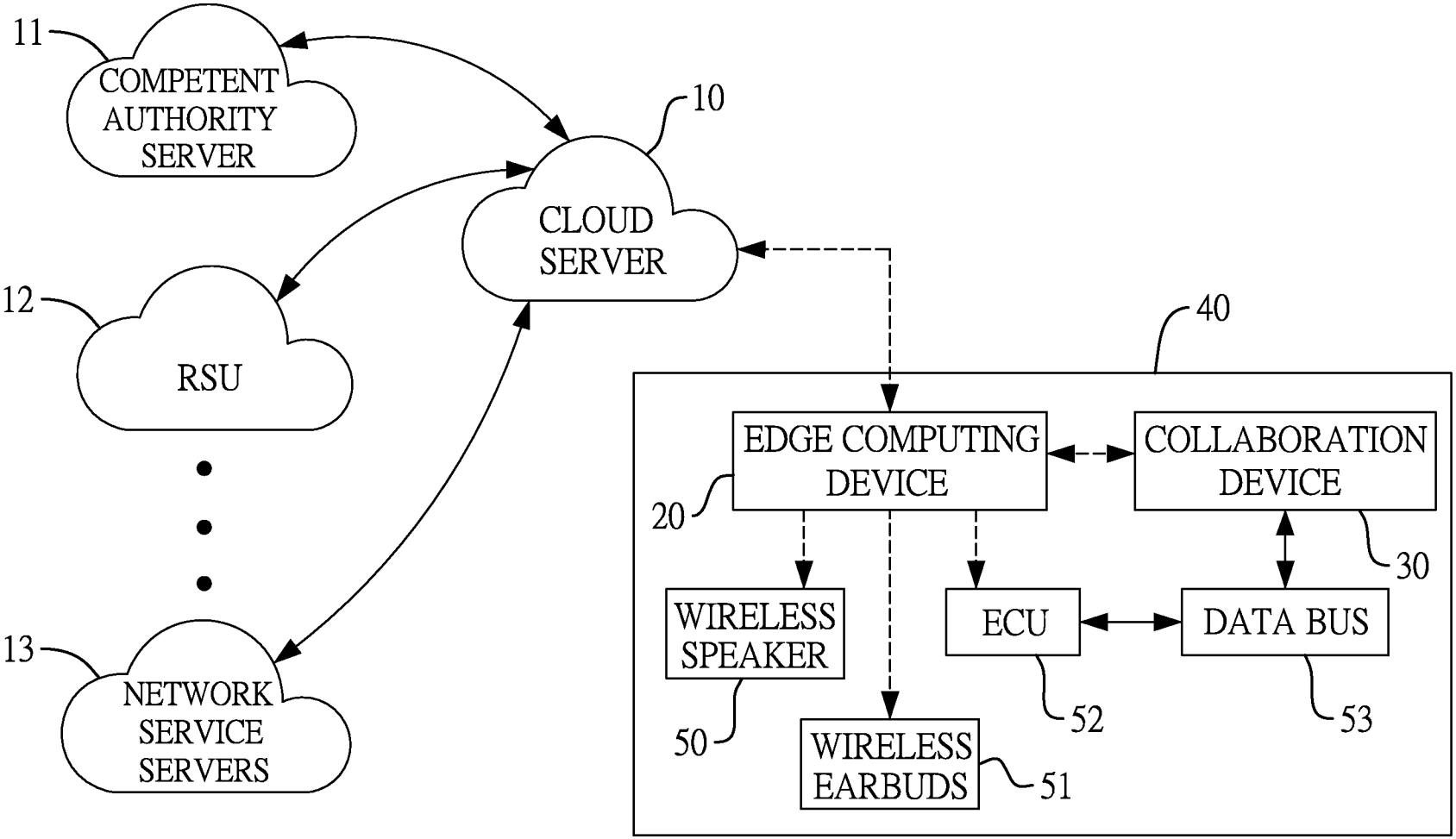
FIG. 1 is a block diagram of an embodiment of the collaborative control system of the present invention.
Figure 2:
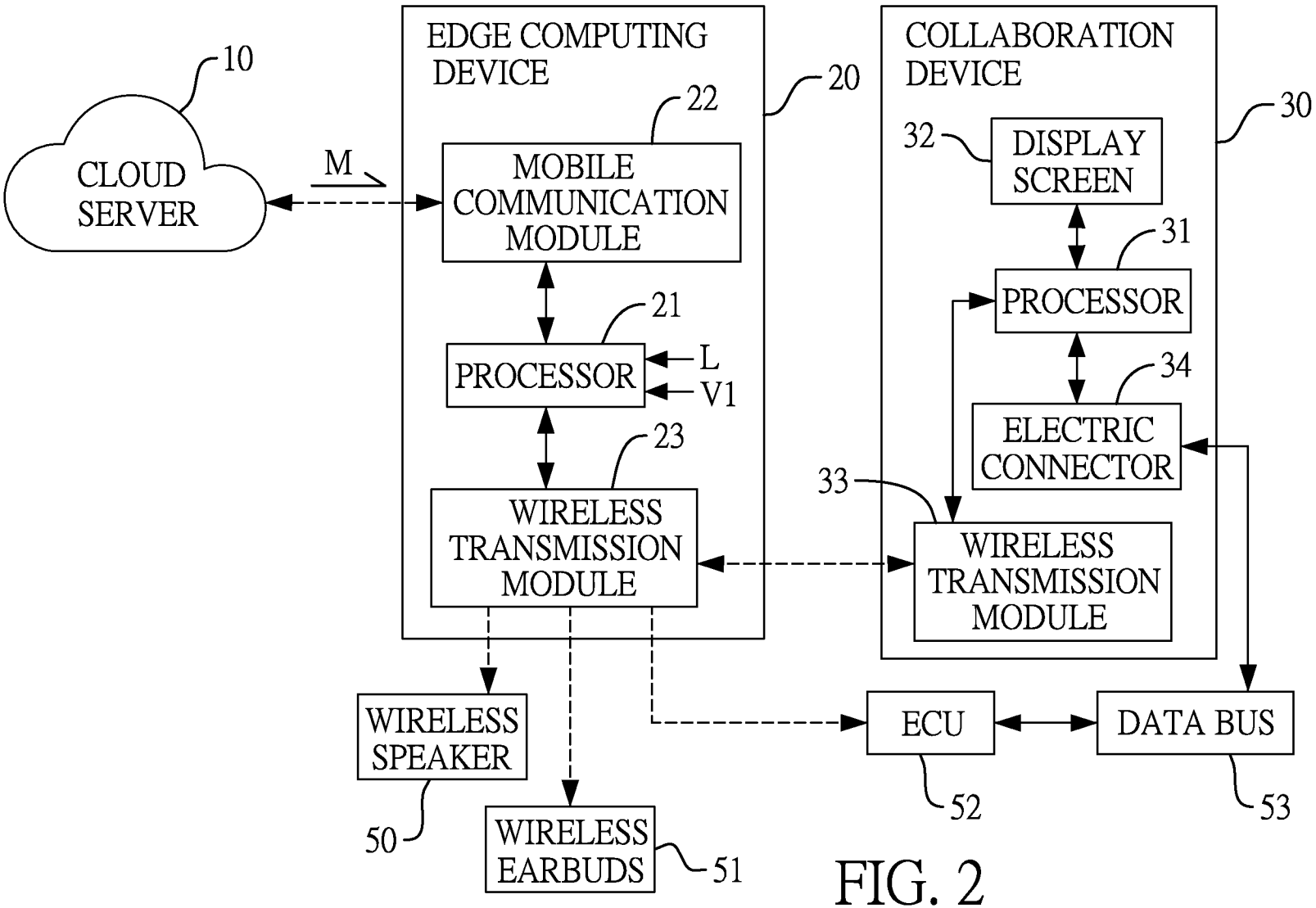
FIG. 2 is a block diagram of an embodiment of the collaborative control system of the present invention.

With reference to FIG. 1 and FIG. 2, an embodiment of the collaborative control system of the present invention comprises a cloud server 10, an edge computing device 20 and a collaboration device 30. The edge computing device 20 and the collaboration device 30 are different electronic devices and are for being mounted in a vehicle 40. For example, the vehicle 40 may be an electric vehicle, a vehicle powered by fuel (such as petrol and diesel), or a hybrid electric vehicle. Or for example, the vehicle 40 may be a scooter, a heavy motorcycle, a sedan, a bus, a truck, or an engineering vehicle. It is to be noted that the vehicle 40 for the present invention is not limited to said vehicles mentioned above. The collaboration device 30 plays a role as an information provider. People, such as a rider/driver or passengers, on the vehicle 40 may see to receive the information displayed on the collaboration device 30. Hence, the people may collaborate with the vehicle 40 to implement driving safety and efficiency.

The cloud server 10 may be a server host with capabilities including network connection, data transmission, data collection, data processing, and data storage. In the present invention, the cloud server 10 receives and stores road coordinates of a country or districts and traffic data corresponding to the road coordinates. The cloud server 10 may also update in real time or periodically update the traffic data of the road coordinates. The traffic data may comprise traffic event information, speed limit values, and/or positions of speed cameras. The traffic event information may include traffic jams, traffic accidents, road closure, and so on. The road may be, but not limited to, freeways, expressways, local ways (such as roads, streets, lanes, and alleys), intersections, tunnels, and so on.

The cloud server 10 may obtain the road coordinates and the traffic data via multiple approaches. For example, the cloud server 10 communicates with a competent authority server 11 to download and store the road coordinates and the traffic data via a network (such as the Internet). The competent authority server 11 may be a server belonging to a transportation ministry or a transportation bureau. Because the staff employed in the competent authority has established the road coordinates and the traffic data in the competent authority server 11, and updates and maintains the road coordinates and the traffic data, the cloud server 10 of the present invention may directly download the latest road coordinates and the latest traffic data from the cloud server 10.

In addition, the cloud server 10 may also communicate with roadside units 12 via the network. In general, the roadside units 12 may be disposed at roads of a country or districts. The roadside unit 12 has a function of forming a communication network with assistant systems of vehicles passing through the roads. The roadside unit 12 can wirelessly transmit local traffic data (nearby such roadside unit 12) to the assistant systems of the vehicles passing through the road where the roadside unit 12 is disposed. In the present invention, the cloud server 10 may directly download and store the traffic data from the roadside units 12. Because the roadside unit 12 is disposed at a specific location, a coordinate of the roadside unit 12 may be regarded as a road coordinate for corresponding to the traffic data of such roadside unit 12. Both the coordinate and the traffic data of the roadside unit 12 are provided to be downloaded by the cloud server 10.

Besides, the cloud server 10 may communicate with other network service servers 13 via the network. The network service servers 13 may provide the cloud server 10 with traffic data. For example, the network service server 13 may be the server "Here Live Sense". Therefore, the cloud server 10 of the present invention may download and store the road coordinates, the traffic data, and other data from the network service server 13.

The edge computing device 20 is adapted to be mounted in the vehicle 40. The edge computing device 20 comprises a processor 21, a mobile communication module 22, and a wireless transmission module 23. The mobile communication module 22 and the wireless transmission module 23 are electrically connected to the processor 21 of the edge computing device 20. The processor 21, the mobile communication module 22, and the wireless transmission module 23 are hardware components. For example, the processor 21 may be an integrated circuit (IC) component. The processor 21 has functions including control, data processing, data computing, program executing, and so on. In the present invention, the processor 21 may execute a software development kit (SDK). The mobile communication module 22 is adapted to communicate with the cloud server 10 via the network, so as to perform a two-way data transmission with the cloud server 10. For example, the mobile communication module 22 may communicate with the cloud server 10 via a fourth generation (4G) mobile communication technique, a fifth generation (5G) mobile communication technique, or a further next generation mobile communication technique. The wireless transmission module 23 may be a short-range wireless transmission module to communicate with on-vehicle electronic devices and to perform a two-way data transmission with the on-vehicle electronic devices. For example, the wireless transmission module 23 may be, but not limited to, a Bluetooth module (BT) or a Bluetooth Low Energy (BLE) module. The wireless transmission module 23 may communicate with objects including a wireless speaker 50, wireless earbuds 51 (such as a true wireless stereo headphone), and/or an electronic control unit 52 (ECU) of the vehicle 40. The wireless transmission module 23 may further communicate with an on-board diagnostic (OBD) system of the vehicle 40 or a vehicle control unit (VCU) of the vehicle 40. Hence, the processor 21 may receive driving data including signals of sensors, signals of indicating lamps, signals of key statuses (such as key ON/key OFF), wheel speed, real-time vehicle speed, heading, vehicle positioning coordinate, navigation map information, and so on via the wireless transmission module 23. For example, the edge computing device 20 may be a user's mobile device, such as a smart phone or a tablet, or a vehicular electronic product.

The collaboration device 30 may be, but not limited to, a liquid crystal display (LCD), such as an in-plane-switching LCD (IPS LCD). The collaboration device 30 comprises a processor 31, a display screen 32, a wireless transmission module 33, and an electric connector 34. The display screen 32, the wireless transmission module 33, and the electric connector 34 are electrically connected to the processor 31 of the collaboration device 30. The processor 31 and the mobile communication module 33 of the collaboration device 30 are hardware components. For example, the processor 31 may be an integrated circuit (IC) component. The processor 31 has functions including control, data processing, data computing, program executing, and so on. The wireless transmission module 33 may be a short-range wireless transmission module. The wireless transmission modules 23, 33 of the edge computing device 20 and the collaboration device 30 communicate with each other to perform a two-way data transmission. The electric connector 34 of the collaboration device 30 may be electrically connected to a data bus 53, such as a controller-area-network (CAN) bus, of the vehicle 40. Hence, the collaboration device 30 may communicate with the ECU 52, the OBD, and/or the VCU via the data bus 53 to perform a two-way data transmission.

The collaboration device 30 may be integrated with a rearview mirror assembly or a dashboard of the vehicle 40. When the user on the vehicle 40 looks at the rearview mirror assembly, the user not only sees the reflection in a mirror of the rearview mirror assembly, but also observes the images displayed on the display screen 32 of the collaboration device 30. Or, the collaboration device 30 may be a displayer mounted on any position in the vehicle 40. The processor 31 of the collaboration device 30 may receive the driving data including signals of sensors, signals of indicating lamps, signals of key statuses (such as key ON/key OFF), wheel speed, real-time vehicle speed, heading, vehicle positioning coordinate, navigation map information, and so on from the ECU 52, the OBD, and/or the VCU via the data bus 53. The processor 31 of the collaboration device 30 may activate the display screen 32 to display the driving data. Besides, the processor 31 of the collaboration device 30 may activate the display screen 32 to display the data received from the wireless transmission module 33.

When the edge computing device 20 executes the SDK, the edge computing device 20 continuously downloads one of the traffic data from the cloud server 10 as an instant traffic datum according to a vehicle positioning coordinate L corresponding to one of the road coordinates in the cloud server 10. The vehicle positioning coordinate L includes latitude and longitude with corresponding positioning time. The edge computing device 20 may obtain the vehicle positioning coordinate L from the driving data as mentioned above. Or, when the edge computing device 20 is the mobile device, the mobile device may launch and perform a global positioning system (GPS) function to generate a positioning coordinate. Because the user carries the mobile device with himself and rides/drives the vehicle 40, the positioning coordinate may indicate an instant position of the vehicle 40. Hence, said positioning coordinate generated from the GPS function of the mobile may be also defined as the vehicle positioning coordinate L. Or, the vehicle 40 may have a GPS module. The processor 21 of the edge computing device 20 may be electrically connected to the GPS module. The GPS module of the vehicle 40 may generate the vehicle positioning coordinate L and transmit the vehicle positioning coordinate L to the processor 21 of the edge computing device 20, such that the processor 21 of the edge computing device 20 may receive the vehicle positioning coordinate L from the GPS module of the vehicle 40.

Figure 3:
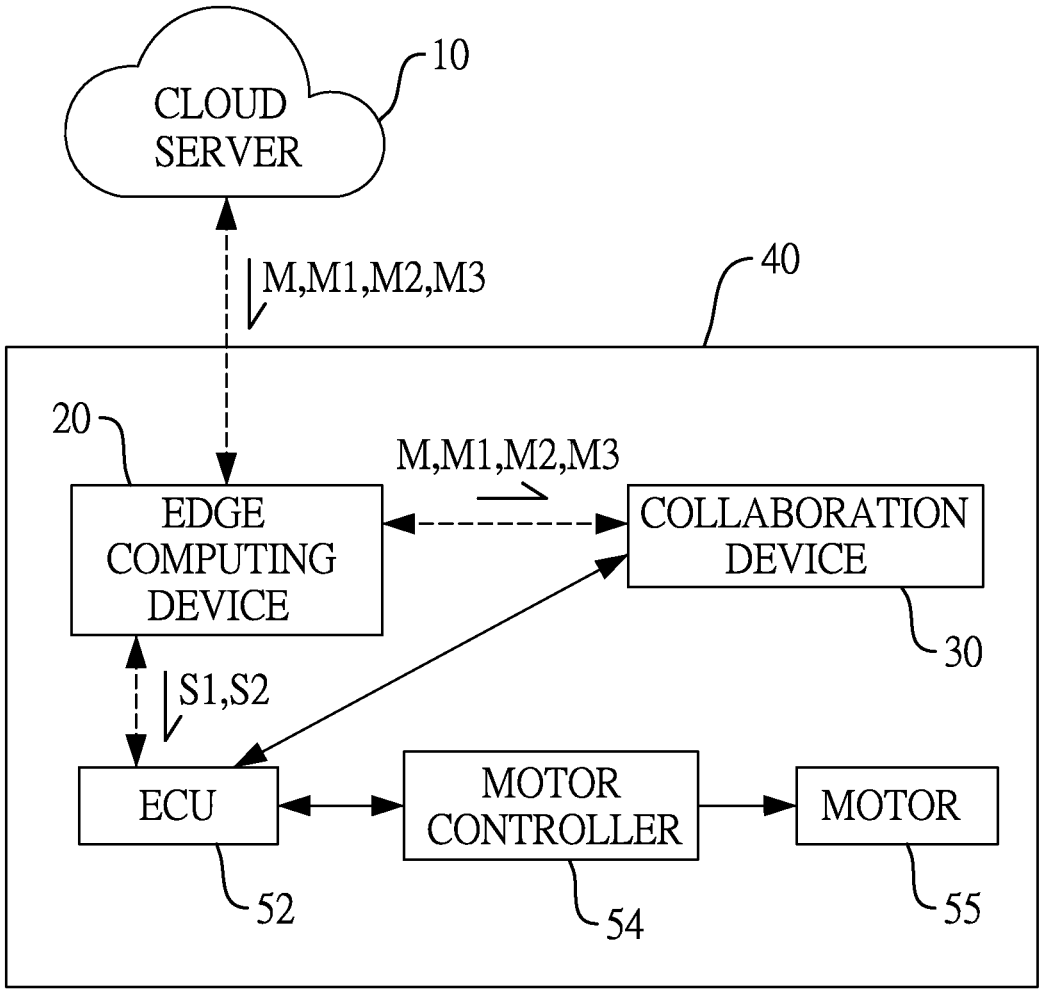
FIG. 3 is a block diagram of an embodiment of the collaborative control system of the present invention applied to an electric scooter.

With reference to FIG. 2 and FIG. 3, when the edge computing device 20 obtains the instant traffic datum M, the edge computing device 20 performs safety-warning function and control function accordingly. For example, the edge computing device 20 may transmit the instant traffic datum M to the collaboration device 30 for the collaboration device 30 to display the instant traffic datum M on the display screen 32, such that people on the vehicle 40 can review the instant traffic datum M.

For example, when the instant traffic data M received by the processor 21 of the edge computing device 20 from the cloud server 10 includes speed camera information M1, the edge computing device 20 may activate the wireless speaker 50 or the wireless earbuds 51 to play a warning sound as a warning message. Besides, the speed camera information M1 can be displayed on the display screen 32 of the collaboration device 30, such that the display screen 32 of the collaboration device 30 may display warning images regarding the speed camera information M1. Or, when the instant traffic datum M received by the processor 21 of the edge computing device 20 from the cloud server 10 includes a speed limit value M2, the processor 21 of the edge computing device 20 determines whether a real-time vehicle speed V1 of the vehicle 40 is higher than the speed limit value M2. The edge computing device 20 may obtain the real-time vehicle speed V1 from the ECU 52, the OBD, or the VCU. When the edge computing device 20 determines that a real-time vehicle speed V1 is higher than the speed limit value M2, the edge computing device 20 may activate the wireless speaker 50 or the wireless earbuds 51 to play a warning sound as a warning message. Besides, the display screen 32 of the collaboration device 30 may display warning images regarding excessive-speed. It could be deduced that when the instant traffic data M received by the processor 21 of the edge computing device 20 from the cloud server 10 includes both the speed camera information M1 and the speed limit value M2, the edge computing device 20 may provide both speed-camera warning and excessive-speed warning as mentioned above. Therefore, the people on the vehicle 40 may directly know whether the vehicle 40 is over speeding or not, or whether the instant road section has speed cameras or not.

As mentioned above, a format of the instant traffic data M may include characters or codes. For example, the processer 21 of the edge computing device 20 may recognize the characters or the codes (such as "AO") in the instant traffic data M as the speed camera information M1. Or, the processer 21 of the edge computing device 20 may recognize other characters or other codes (such as "60 kph") in the instant traffic data M as the speed limit value M2.

With reference to FIG. 3, the vehicle 40 may be an electric scooter as an example. The electric scooter comprises a motor controller 54 and a motor 55. The motor controller 54 may be controllable by the ECU 52 to adjust a motor speed of the motor 55 in order to control a driving speed of the electric scooter. The processor 21 of the edge computing device 20 may output a control command to the ECU 52.

Figure 4:
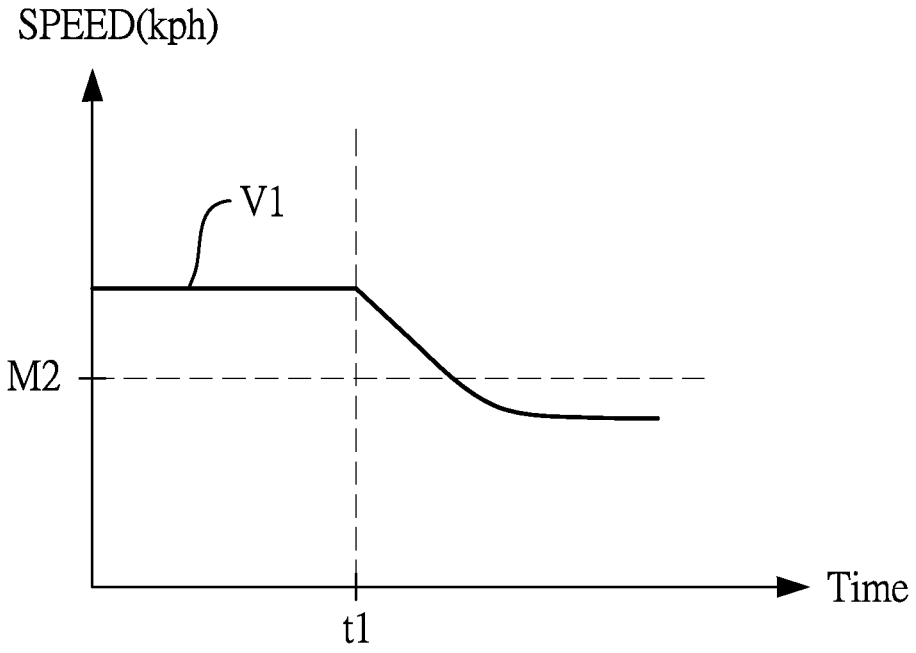
FIG. 4 is a waveform diagram of the real-time vehicle speed of an embodiment of the present invention.

When the instant traffic datum M received by the processor 21 of the edge computing device 20 from the cloud server 10 includes the speed limit value M2, the processor 21 determines whether the real-time vehicle speed V1 of the vehicle 40 is higher than the speed limit value M2. When the edge computing device 20 determines that the real-time vehicle speed V1 is higher than the speed limit value M2, the edge computing device 20 outputs a speed-limiting command S1 to the ECU 52. The ECU 52 controls the motor controller 54 according to the speed-limiting command S1 to limit the motor speed of the motor 55 for a purpose to limit the real-time vehicle speed V1 to be equal to or lower than the speed limit value M2. With reference to FIG. 4, for example, a road section may be limited to a speed limit value M2. The vehicle 40 does not enter the road section yet before t1 and its real-time vehicle speed V1 is higher than the speed limit value M2. Please note that the vehicle 40 enters the road section after t1. Hence, the edge computing device 20 may output the speed-limiting command S1 to the motor controller 54 after t1 for a purpose to decrease the real-time vehicle speed V1, until the edge computing device 20 determines that the real-time vehicle speed V1 is equal to or lower than the speed limit value M2. In other words, when the edge computing device 20 determines that the real-time vehicle speed V1 is equal to or lower than the speed limit value M2, the edge computing device 20 may stop outputting the speed-limiting command S1. After t1, the people (including the rider/driver) on the vehicle 40 may obviously feel a deceleration and be directly aware that the vehicle 40 is traveling in a speed-limited road section. The rider/driver may pay more attention when riding/driving. Besides, although the road section has speed cameras, the rider/driver would not violate the traffic rules due to over speeding because the vehicle 40 has been decelerated.

Figure 5:
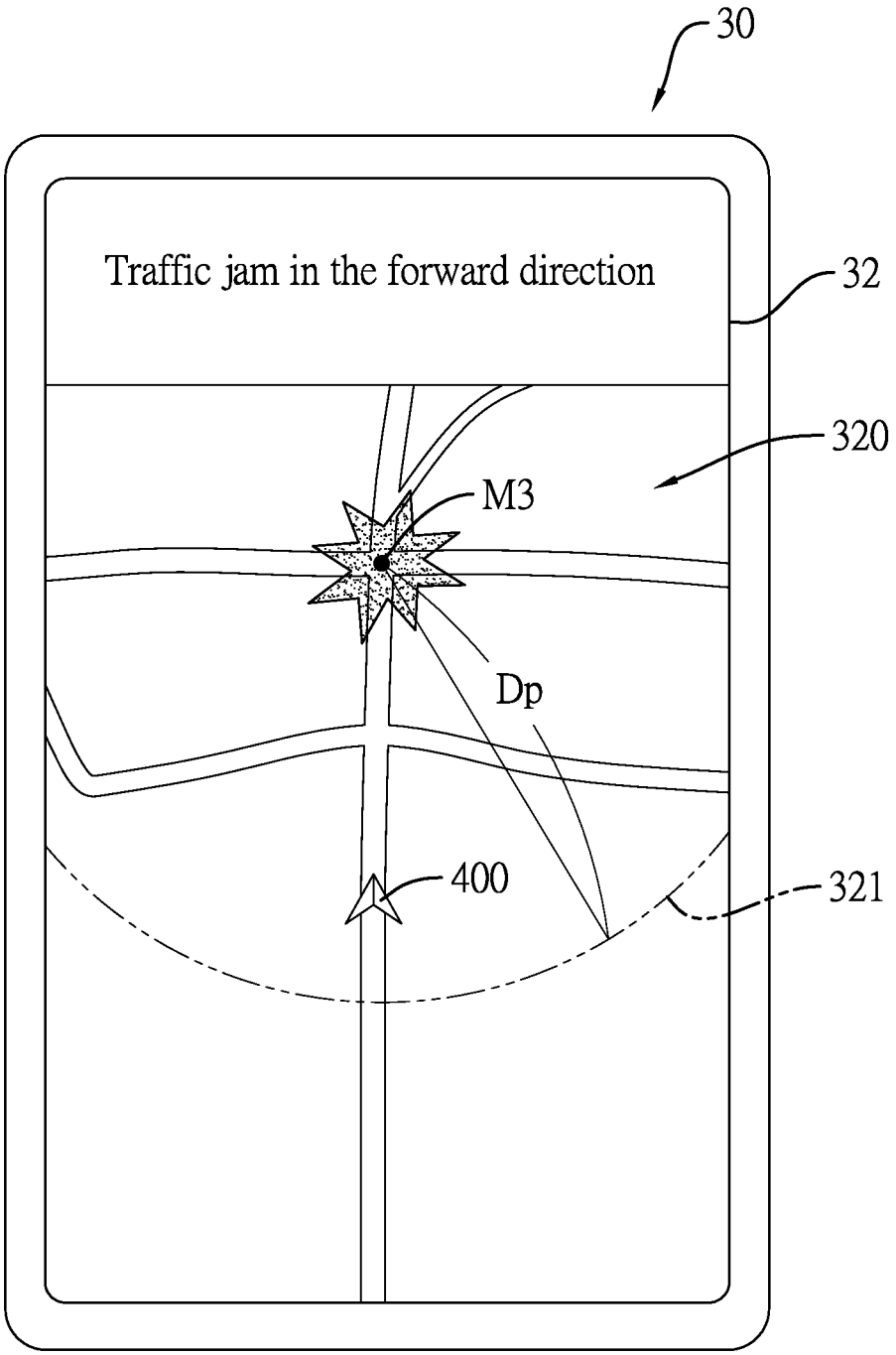
FIG. 5 is a schematic view of the pre-warning function of the present invention.

The present invention also provides a pre-warning function. With reference to FIG. 3 and FIG. 5, the instant traffic datum M received by the processor 21 of the edge computing device 20 from the cloud server 10 includes traffic event information M3. The traffic event information M3 may include a traffic-control event, a traffic jam event, a traffic-accident event, a road-closed event, and so on. The processor 21 of the edge computing device 20 may activate the wireless speaker 50 or the wireless earbuds 51 to play the warning sound according to the traffic event information M3. The processor 21 of the edge computing device 20 may also transmit the traffic event information M3 to the collaboration device 30. The collaboration device 30 may display the traffic event information M3 on the display screen 32. Preferably, the collaboration device 30 may display the traffic event information M3 integrated into map information 320 with a prompting message. The prompting message may be "Traffic jam in the forward direction" as shown in FIG. 5. By doing so, when the rider/driver on the vehicle 40 receives the traffic event information M3 via the collaboration device 30, the rider/driver may change to another lane or decelerate the vehicle 40 in advance in order not to affect the itinerary and to increase the driving efficiency.

As mentioned above, the format of the instant traffic data M may include characters or codes. For example, the processer 21 of the edge computing device 20 may recognize the characters or the codes (such as "traffic control", "traffic jam", "traffic accident", and "road closed") in the instant traffic data M as the traffic event information M3.

In a further application, the processor 21 of the edge computing device 20 may output a pre-warning command S2 to the ECU 52 of the vehicle 40 according to the road coordinate of the traffic event information M3 and the vehicle positioning coordinate L of the vehicle 40, wherein the vehicle positioning coordinate L corresponds to a position of a vehicle symbol 400 as shown in FIG. 5. The ECU 52 controls the motor controller 54 according to the pre-warning command S2 for the motor controller 54 to adjust the motor speed of the motor 55 accordingly. For example, the pre-warning command S2 may be a deceleration command to decrease the motor speed of the motor 55. The edge computing device 20 outputs the deceleration command to the ECU 52 until the edge computing device 20 determines that a real-time vehicle speed V1 of the vehicle 40 is equal to or lower than a speed threshold. In other words, when the edge computing device 20 determines that the real-time vehicle speed V1 is equal to or lower than the speed threshold, the edge computing device 20 may stop outputting the deceleration command. The speed threshold is adjustable and is a datum stored in the edge computing device 20. The speed threshold may be equal to or higher than 0 kilometer-per-hour (kph). For example, a minimum value of the speed threshold may be 0 kph for the purpose to stop the vehicle 40. Therefore, the present invention may automatically decelerate or stop the vehicle 40 before the vehicle 40 reaches the position where the traffic event information M3 occurs. The vehicle may not get too close to or pass through the position where the traffic event information M3 occurs and may therefore avoid an accident.

The processor 21 of the edge computing device 20 may output the pre-warning command S2 to the ECU 52 as in the following examples.

A first example to output the pre-warning command S2:

The processor 21 of the edge computing device 20 computes a relative distance according to the road coordinate of the traffic event information M3 and the vehicle positioning coordinate L of the vehicle 40, wherein the relative distance indicates a distance between the vehicle positioning coordinate L and the road coordinate where the traffic event information M3 occurs. The processor 21 of the edge computing device 20 determines whether the relative distance is equal to or lower than a pre-warning distance Dp. The pre-warning distance Dp is adjustable and is a datum stored in the edge computing device 20. When the edge computing device 20 determines that the relative distance is equal to or lower than the pre-warning distance Dp, the edge computing device 20 outputs the pre-warning command S2.

A second example to output the pre-warning command S2:

The processor 21 of the edge computing device 20 computes a pre-warning area 321 according to the road coordinate of the traffic event information M3 and the pre-warning distance Dp. For example, as shown in FIG. 5, the pre-warning area 321 may be a circular area. The road coordinate where the traffic event information M3 occurs is as a circle center of the pre-warning area 321. The pre-warning distance Dp is as a radius of the pre-warning area 321. The processor 21 of the edge computing device 20 determines whether the vehicle positioning coordinate L of the vehicle 40 (the position of the vehicle positioning coordinate L could be referred to the vehicle symbol 400 in FIG. 5) is located within the pre-warning area 321. When the processor 21 of the edge computing device 20 determines that the vehicle positioning coordinate L of the vehicle 40 is located within the pre-warning area 321, the processor 21 of the edge computing device 20 outputs the pre-warning command S2 to the ECU 52.

In the present invention, according to the collaboration among the cloud server 10, the collaboration device 30 and the edge computing device 20, the instant traffic datum M is provided to the people on the vehicle 40 in real time for the people to see to receive the instant traffic datum M. Besides, the present invention may provide the pre-warning function. In particular, the cloud server 10 of the present invention obtains the latest road coordinates and the latest traffic data via multiple approaches. Hence, no matter where the vehicle 40 goes, the people on the vehicle 40 can see to receive the latest traffic data on the display screen 32 of the collaboration device 30, so as to provide the rider/driver with a more obvious prompt. In addition, the present invention may automatically decelerate the vehicle 40 by the implementation of the speed-limiting command S1 and the pre-warning command S2 as mentioned above, so as to enhance driving safety and efficiency. Besides, the traffic conditions would be safer.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A collaborative control system for a vehicle, comprising:

a cloud server storing road coordinates and traffic data corresponding to the road coordinates; wherein the cloud server communicates with a competent authority server to download and store the road coordinates and the traffic data;

a collaboration device for being mounted in the vehicle; and an edge computing device communicating with the cloud server and the collaboration device for being mounted in the vehicle, wherein the edge computing device downloads one of the traffic data from the cloud server as an instant traffic datum according to a vehicle positioning coordinate corresponding to one of the road coordinates, and transmits the instant traffic datum to the collaboration device; and the collaboration device displays the instant traffic datum.

2. The collaborative control system as claimed in claim 1, wherein the cloud server communicates with roadside units to download and store the road coordinates and the traffic data.

3. The collaborative control system as claimed in claim 1, wherein the edge computing device comprises a processor and a mobile communication module and a wireless transmission module that are electrically connected to the processor of the edge computing device;

the mobile communication module of the edge computing device communicates with the cloud server via a network;

the collaboration device comprises a processor and a display screen, a wireless transmission module, and an electric connector that are electrically connected to the processor of the collaboration device;

the wireless transmission module of the collaboration device communicates with the wireless transmission module of the edge computing device;

the electric connector of the collaboration device is electrically connected to a data bus of the vehicle; and the display screen of the collaboration device displays the instant traffic datum.

4. The collaborative control system as claimed in claim 3, wherein the wireless transmission module of the edge computing device receives driving data including a real-time vehicle speed of the vehicle.

5. The collaborative control system as claimed in claim 1, wherein the edge computing device comprises a wireless transmission module communicating with a wireless speaker, wireless earbuds, an electronic control unit of the vehicle, an on-board diagnostic system of the vehicle, or a vehicle control unit of the vehicle.

6. The collaborative control system as claimed in claim 5, wherein the edge computing device activates the wireless speaker or the wireless earbuds according to the instant traffic datum.

7. The collaborative control system as claimed in claim 1, wherein the collaboration device comprises an electric connector receiving driving data of the vehicle via a data bus of the vehicle; and a display screen displaying the driving data of the vehicle.

8. The collaborative control system as claimed in claim 1, wherein the instant traffic datum received by the edge computing device from the cloud server includes a speed limit value; and when the edge computing device determines that a real-time vehicle speed of the vehicle is higher than the speed limit value, the edge computing device outputs a speed-limiting command.

9. The collaborative control system as claimed in claim 8, wherein the instant traffic datum received by the edge computing device from the cloud server includes speed camera information.

10. The collaborative control system as claimed in claim 1, wherein the instant traffic datum received by the edge computing device from the cloud server includes traffic event information;

the edge computing device transmits the traffic event information to the collaboration device; and the collaboration device displays the traffic event information integrated into map information.

11. The collaborative control system as claimed in claim 1, wherein the instant traffic datum received by the edge computing device from the cloud server includes traffic event information;

the edge computing device outputs a pre-warning command according to the road coordinate of the traffic event information and a vehicle positioning coordinate of the vehicle; and a motor speed of a motor of the vehicle is controllable by the pre-warning command.

12. The collaborative control system as claimed in claim 11, wherein the pre-warning command is a deceleration command to decrease the motor speed of the motor;

the edge computing device outputs the deceleration command until the edge computing device determines that a real-time vehicle speed of the vehicle is equal to or lower than a speed threshold; and the speed threshold is a datum stored in the edge computing device.

13. The collaborative control system as claimed in claim 12, wherein the edge computing device computes a relative distance according to the road coordinate of the traffic event information and the vehicle positioning coordinate of the vehicle;

when the edge computing device determines that the relative distance is equal to or lower than a pre-warning distance, the edge computing device outputs the pre-warning command; and the pre-warning distance is a datum stored in the edge computing device.

14. The collaborative control system as claimed in claim 12, wherein the edge computing device computes a pre-warning area according to the road coordinate of the traffic event information as a circle center of the pre-warning area and a pre-warning distance as a radius of the pre-warning area;

the pre-warning distance is a datum stored in the edge computing device; and when the edge computing device determines that the vehicle positioning coordinate of the vehicle is located within the pre-warning area, the edge computing device outputs the pre-warning command.

* * * * *